US008481632B2

(12) United States Patent
Van Bergen et al.

(10) Patent No.: US 8,481,632 B2
(45) Date of Patent: Jul. 9, 2013

(54) METHOD FOR IMPROVING THE FLOWABILITY OF A MIXTURE THAT CONTAINS WAX AND OTHER HYDROCARBONS

(75) Inventors: Petrus Franciscus Van Bergen, Amsterdam (NL); Menno Anton Van Dijk, Amsterdam (NL); Albert Jan Zeeman, Amsterdam (NL)

(73) Assignee: Shell Oil Company, Houston, TX (US)

( * ) Notice: Subject to any disclaimer, the term of this patent is extended or adjusted under 35 U.S.C. 154(b) by 8 days.

(21) Appl. No.: 11/791,194

(22) PCT Filed: Nov. 23, 2005

(86) PCT No.: PCT/EP2005/056173

§ 371 (c)(1), (2), (4) Date: Oct. 16, 2007

(87) PCT Pub. No.: WO2006/056578

PCT Pub. Date: Jun. 1, 2006

(65) Prior Publication Data

US 2008/0194761 A1 Aug. 14, 2008

(30) Foreign Application Priority Data

Nov. 24, 2004 (EP) ..... 04257282

(51) Int. Cl.
*C08L 91/06* (2006.01)

(52) U.S. Cl.
USPC ..... 524/487; 524/474; 524/476

(58) Field of Classification Search
USPC ..... 524/474, 476, 487
See application file for complete search history.

(56) References Cited

U.S. PATENT DOCUMENTS

| | | | | |
|---|---|---|---|---|
| 3,447,916 | A | 6/1969 | Edwards | 44/62 |
| 5,906,970 | A | 5/1999 | Tack | 508/470 |
| 2004/0024087 | A1 * | 2/2004 | Bruchmann et al. | 523/160 |
| 2004/0163995 | A1 | 8/2004 | Cornelisse | 208/48 |

FOREIGN PATENT DOCUMENTS

| | | | |
|---|---|---|---|
| EP | 448166 | | 9/1991 |
| WO | WO8801180 | | 2/1988 |
| WO | WO9916810 | | 4/1999 |
| WO | WO0056804 | | 9/2000 |
| WO | WO0058388 | | 10/2000 |
| WO | WO 01/77270 | * | 10/2001 |
| WO | WO 02/102928 | * | 12/2002 |
| WO | WO 2004/022909 | * | 3/2004 |

* cited by examiner

*Primary Examiner* — Peter Szekely

(57) ABSTRACT

A method for improving the flowability of a mixture that contains wax and other hydrocarbons, which method comprises adding to the mixture an amount of a dendrimeric hyperbranched polyester amide.

16 Claims, No Drawings

METHOD FOR IMPROVING THE FLOWABILITY OF A MIXTURE THAT CONTAINS WAX AND OTHER HYDROCARBONS

The present application claims priority from European Patent Application No. 04257282.6 filed 24 Nov. 2004.

FIELD OF THE INVENTION

The present invention relates to a method for improving the flowability of a mixture that contains wax and other hydrocarbons.

BACKGROUND OF THE INVENTION

Hydrocarbon mixtures, such as crude oils and certain fuel oils derived therefrom, may contain considerable amounts of wax. The wax present in crude oils and fractions thereof primarily consists of paraffins but may also contain some non-linear alkanes. This wax is normally dissolved in the oil but may precipitate from these hydrocarbon mixtures under certain circumstances. This precipitation may in particular happen when the hydrocarbon mixture is cooled. When the temperature is lowered sufficiently one may observe small wax crystals occurring in the fluid. These crystals may form deposits at surfaces and they will also significantly alter the flow properties, such as the viscosity, of the hydrocarbon fluid. In the production process of crude oil and gas, these phenomena pose significant challenges. The deposits may partially or fully block flowlines and when the viscosity has become too high, the liquids may not flow at all even when there are no or few deposits. The hydrocarbon mixture may even solidify completely.

Several methods exist to prevent or mitigate wax induced flow impairment. Examples include the insulation or heating of conduits, thus maintaining a high temperature of the fluids, regular "pigging" of flowlines, which comprises a method of mechanically scraping the inside of the flowlines in order to remove the deposits. However such methods are not always possible or economically viable.

This has led to the development of certain chemical compounds which when added to the said hydrocarbon fluids alter the effect of wax. Some compounds may reduce the cloud point, those are also known as wax inhibitors, and some reduce the pour point and these are also known as pour point depressants.

Various chemical compounds are known in the prior art to affect the wax deposition and flow behaviour of hydrocarbon fluids. These compounds are based on polymers with various chemical compositions. U.S. Pat. No. 3,447,916 describes linear polyesters or polyamides with side-branching based on a diacid or diacid anhydride, a monoacid and a polyol or hydroxylamine for use pour point depressants for fuel oils. European Patent Application EP-A 448166 describes polymer compositions comprising a polymer of an ethylenically unsaturated compound, such as $C_{18-26}$ n-alkyl acrylates or copolymers of such acrylates and vinylpyridine For a successful application of these products, various other properties are also relevant. For example, the viscosity of the solution in which these compounds are delivered. Sometimes these solutions have themselves a relatively high pour point. In circumstances where it is desired to pass the fluidity improvers along a pipeline in a cold environment, this is highly undesirable. This problem becomes relevant in the above-mentioned EP-A 448166 since the polymers used in the dispersions of this prior art have a molecular weight (Mn) of well above 10,000. Examples show molecular weights of 25,000 to 76,000. The prior art solves this problem by incorporating the polymer or copolymer in a dispersion that further contains a surfactant and a polyol. However, in cases were added fluids may come into contact with the environment, environmental properties, such as toxicity and biodegradability, also become relevant.

SUMMARY OF THE INVENTION

According to the present invention, there is a whole new class of compounds that combines wax inhibiting and pour point depressing properties with a very low viscosity, good environmental properties and various other advantages over currently known products.

The present invention therefore provides a method for improving the flowability of a mixture that contains wax and other hydrocarbons, which method comprises adding to the mixture an amount of a dendrimeric hyperbranched polyester amide.

DETAILED DESCRIPTION OF THE INVENTION

The use of dendrimeric hyperbranched polyester amides has the advantage that molecules with a relatively low molecular weight may be used, which means that the pour point of these compounds will be relatively low.

The use of hyperbranched polyester amides in solubilising asphaltenes in hydrocarbon mixtures has been described in WO-A 02/102928. Later issued as U.S. Pat. No. 7,122,113, which is herein incorporated by reference in its entirety. However, asphaltenes are polar molecules that aggregate together inter alia through aromatic orbital association. Since waxes are predominantly normal paraffins that do not contain aromatic moieties, it is surprising that hyperbranched polyester amides having a similar backbone compared to those described in WO-A 02/102928 have a beneficial effect on wax-containing hydrocarbon mixtures.

Dendrimeric compounds are in essence three-dimensional, highly branched oligomeric or polymeric molecules comprising a core, a number of branching generations and an external surface composed of end groups. A branching generation is composed of structural units, which are bound radially to the core or to the structural units of a previous generation and which extend outwards. The structural units have at least two reactive monofunctional groups and/or at least one monofunctional group and one multifunctional group. The term multifunctional is understood as having a functionality of 2 or higher. To each functionality a new structural unit may be linked, a higher branching generation being produced as a result. The structural units can be the same for each successive generation but they can also be different. The degree of branching of a particular generation present in a dendrimeric compound is defined as the ratio between the number of branchings present and the maximum number of branchings possible in a completely branched dendrimer of the same generation. The term "functional end groups of a dendrimeric compound" refers to those reactive groups, which form part of the external surface. Branchings may occur with greater or lesser regularity and the branchings at the surface may belong to different generations depending on the level of control exercised during synthesis. Dendrimeric compounds may have defects in the branching structure, may also be branched asymmetrically or have an incomplete degree of branching in which case the dendrimeric compound is said to contain both functional groups and functional end groups.

Dendrimeric compounds have also been referred to as "starbust conjugates" (Starburst is a registered trademark of Dendritech, Inc.), for instance in International Patent Application Publication WO-A 88/01180. Such compounds are described as being polymers characterised by regular dendritic (tree-like) branching with radial symmetry.

U.S. Pat. No. 5,906,970 describes dendritic polyamidoamides and polyaminoamines. These compounds were prepared by the iterative reaction of a ammonia or a polyamine with acrylonitrile and subsequent hydrogenation of the obtained product, and so on. The thus obtained crude polyamines were modified by Michael addition to long-chain acrylate esters. The obtained crude reaction products were tested as cold flow improver additives for fuel oils. A disadvantage of these dendritic compounds is their difficult multistep synthesis with a very low overall yield of the desired dendritic compounds, as well as their usually low solubility in apolar solvents without extensive modification, which is illustrated by the difficulties to purify the polyamines.

Contrary to the dendritic compounds described in U.S. Pat. No. 5,906,970, the dendrimeric compound used in the present invention is a hyperbranched polyester amide. Therefore the compound includes the reaction product of an acid and both an alcohol and an amine functionality. As indicated above, the functionality of the reactants must be such that a dendrimeric structure is attained. That can be achieved in a number of ways. A preferred class of dendrimeric compounds giving rise to modification of wax crystallisation and flow properties comprises the so-called hyperbranched polyesteramides, commercially referred to as HYBRANES (the word HYBRANE is a registered trademark of Koninklijke DSM NV). The preparation of such compounds has been described in more detail in International Patent Application Nos. WO-A-99/16810, WO-A-00/58388 and WO-A-00/56804.

Accordingly, the dendrimeric hyperbranched polyester amide is a condensation polymer containing ester groups and at least one amide group in the backbone, having at least one hydroxyalkylamide end group. The term "hyperbranched" is used within this specification as defined in the IUPAC Compendium of Macromolecular Nomenclature, Metanomski, W. V., Ed.; Blackwell Scientific Publications, Oxford, UK, 1991. According to this definition, a structure-based hyperbranched polymer may be defined as any polymer in which the structural repeating unit (also specified by IUPAC as "constitutional repeating unit") has a connectivity of more than two.

The dendrimeric hyperbranched polyester amide according to the subject invention may be obtained through polycondensation of mono- and/or bis-hydroxyalkylamides of bivalent carboxylic acids. This monohydroxyalkylamide of a bivalent carboxylic acid generally has the formula (I):

(I)

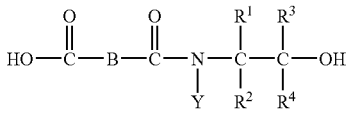

and the bishydroxyalkylamide of a bivalent carboxylic acid generally can be represented by formula (II):

(II)

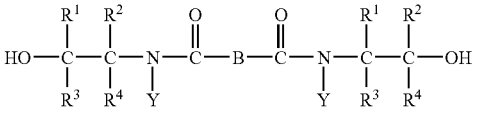

wherein $R^1$, $R^2$, $R^3$ and $R^4$ may, independently of one another, be the same or different, H, ($C_6$-$C_{10}$) aryl or ($C_1$-$C_8$)(cyclo) alkyl radical, Y may represent

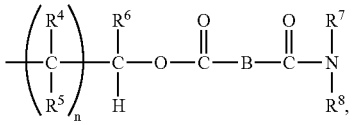

H, a ($C_1$-$C_{20}$) alkyl group or ($C_6$-$C_{12}$) aryl group, and B is an optionally substituted, aryl or (cyclo)alkyl aliphatic diradical. $R^7$ and $R^8$ may, independently of one another, be chosen from the group of optionally heteroatom substituted ($C_6$-$C_{10}$) aryl-groups or optionally heteroatom substituted ($C_1$-$C_{28}$) alkyl-groups, and n=1-4; preferably n is 1.

Consequently, the hyperbranched polymer according to the invention generally comprises the amide and the ester groups alternating along the main and side chains as follows:

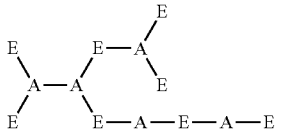

wherein a diamide is coupled with alternating ester (E) amide (A) groups. In the polymers according to the invention (3)-hydroxyalkylamide groups can be present both as an end group

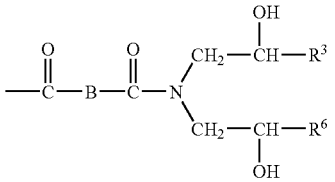

and as a pendant side chain group

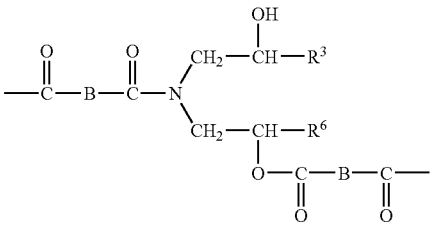

B may be for example a (methyl-)-1,2-ethylene, (methyl)-1,2-ethylidene, 1,3-propylene, (methyl-)1,2-cyclohexyl, (methyl-)1,2-phenylene, 1,3-phenylene, 1,4-phenylene, 2,3-norbornyl, 2,3-norbornen-5-yl and/or (methyl-)1,2 cyclohex-4-enyl radical. Depending on the starting monomers chosen, the variables B, $R^1$, $R^2$, $R^3$, $R^4$, $R^5$ and $R^6$ in the molecule or mixture of molecules can be selected to be the same or different per variable. Generally, the molar amount of amide bounds in the chain is higher than the amount of ester bounds.

The hydroxyalkylamide functionality of the polymer is generally between 2 and 250 and preferably between 5 and 50. Functionality is the average number of reactive groups of the specific type per molecule in the polymer composition. According to a preferred embodiment of the invention the hydroxyalkylamide functionality of the polymer is above 2, more preferably above 2.5, yet more preferably above 3, even more preferably above 4, and most preferably above 5.

Compounds belonging to this class of dendrimeric hyperbranched polyester amides are suitably produced by reacting a cyclic anhydride with an alkanolamine giving rise to dendrimeric compounds by allowing them to undergo a number of (self-)condensation reactions leading to a predetermined level of branching. It is also possible to use more than one cyclic anhydride and/or more than one alkanolamine.

The alkanolamine may be a dialkanolamine, a trialkanolamine or a mixture thereof. Therefore, the hyperbranched polyester amide used is preferably based on (self-)condensation reactions between a cyclic anhydride and a di- or trialkanolamine or a mixture thereof. Examples of suitable dialkanolamines are diethanolamine, bis(2-hydroxy-1-butyl) amine, dicyclohexanolamine and diisopropanolamine. Diisopropanolamine is particularly preferred. As an example of a suitable trialkanolamine reference is made to triethanolamine.

Suitable cyclic anhydrides comprise succinic anhydride, glutaric anhydride, tetrahydrophthalic anhydride, hexahydrophthalic anhydride, phthalic anhydride, norbornene-2,3-dicarboxylic anhydride, naphthalenic dicarboxylic anhydride. The cyclic anhydrides may contain substituents, in particular hydrocarbon (alkyl or alkenyl) substituents. The substituents suitably comprise from 1 to 25 carbon atoms. Suitable examples include 4-methylphthalic anhydride, 4-methyltetrahydro- or 4-methylhexahydrophthalic anhydride, methyl succinic anhydride, poly(isobutyl)-succinic anhydride and 2-dodecenyl succinic anhydride. Mixtures of anhydrides can also be used. The (self-) condensation reaction is suitably carried out without a catalyst at temperatures between 100 and 200° C. By carrying out such (self-)condensation reactions compounds will be obtained having amide-type nitrogen moieties as branching points and with hydroxyl end groups in the base polymer. Depending on the reaction conditions, predetermined molecular weight ranges and number of end groups can be set. For instance, using hexahydrophthalic anhydride and diisopropanolamine polymers can be produced having a number average molecular weight tuned between 500 and 50,000, preferably between 670 and 10,000, more preferably between 670 and 5000. The number of hydroxyl groups per molecule in such case is suitably in the range between 5 and 13.

The best results are obtained with polyester amides in which the anhydride is aliphatic, preferably, non-cyclic aliphatic. Hence, preferred anhydrides include glutaric acid anhydride and in particular succinic acid anhydride, optionally substituted with one or more alkyl or alkenyl substituents.

Functionalised dendrimeric compounds are characterised in that one or more of the reactive functional groups present in the dendrimeric compounds have been allowed to react with active moieties different from those featuring in the structural units of the starting dendrimeric compounds. These moieties can be selectively chosen such that, with regard to its ability to affect wax formation/precipitation and fluidity, the functionalised dendrimeric compound outperforms the dendrimeric compound.

The hydroxyl group is one example of a functional group and functional end group of a dendrimeric compound.

Dendrimeric compounds containing hydroxyl groups can be functionalised through well-known chemical reactions such as esterification, etherification, alkylation, condensation and the like. Functionalised dendrimeric compounds also include compounds that have been modified by related but not identical constituents of the structural units such as different amines which as such may also contain hydroxyl groups. Another suitable functional end group can be a carboxylic group, which remains after reaction of the cyclic anhydride with an alcohol group.

The functional end groups (hydroxyl or carboxylic groups) of the polycondensation products can be modified by further reactions as disclosed in the above-mentioned applications WO-A-00/58388 and WO-A-00/56804. Suitable modification can take place by reaction of at least part of the hydroxyl end groups with carboxylic acids, or of the carboxylic group with an alcohol group. Another type of modification can be obtained by partial replacement of the alkanolamine reactant by secondary amines, such as N,N-bis-(3-dimethylaminopropyl)amine.

Preferably, the polyester amide has been functionalised by a reaction with $C_4$-$C_{40}$ carboxylic acids or $C_{4-40}$ alcohols to provide the dendrimeric compound with $C_{4-40}$ alkyl end groups. It has been found that thus modified hyperbranched polyester amides show excellent pour point depressing properties. The $C_{4-40}$ chain can be selected from a wide range. Particularly effective have been proven hyperbranched polyester amides with an alkyl chain containing from 8 to 36, more preferably from 12 to 30 carbon atoms. Suitable carboxylic acids include behenic or stearic acid. Suitable alcohols include n-alkanols with 12 to 30, in particular from 20 to 26 carbon atoms.

It has been found that although compounds with relatively high number average molecular weight may be used, e.g., up to a Mn of 50,000, smaller compounds are also very effective. Therefore, preferably a hyperbranched polyester amide is used having a number average molecular weight from 500 to 50,000, preferably, from 1000 to 9,500. Advantages of smaller molecules include a lower viscosity and a lower pour point of the compound itself.

The amount of the hyperbranched polyester amide in the hydrocarbon mixture is dependent on a number of factors. These factors include the concentration of wax in the hydrocarbon mixture and the temperature at which the mixture will be exposed. Generally, the compounds show an effect at a level of as little as 50 ppmw, based on total of hydrocarbon mixture. Typically, the amount of hyperbranched polyester amide ranges from 0.01 to 10% wt, based on the total of hydrocarbon fluid and dendrimeric hyperbranched polyester amide.

The hyperbranched polyester amide compound may be added to the hydrocarbon mixture in pure form, but it may also be added in the form of a concentrated solution.

The hydrocarbon mixture to which the hyperbranched polyester amide is added, is suitably a crude oil, but also fuels (in particular diesel fuel) or oil condensates as well as hydrocarbon mixtures comprising paraffins obtained by a Fischer-Tropsch process are suitable substrates for the polyester amides. The hydrocarbon mixture containing wax may be mixed with other fluids, such as water, brine or gas and the resulting mixture may be passed through a conduit or flow line. The hydrocarbon mixture preferably is a fluid under the relevant application conditions.

The hydrocarbon mixture may also contain other oil-field chemicals such as corrosion and scale inhibitors. Suitable corrosion inhibitors comprise primary, secondary or tertiary amines or quaternary ammonium salts, preferably amines or salts containing at least one hydrophobic group. Examples of corrosion inhibitors comprise benzalkonium halides, preferably benzyl hexyldimethyl ammonium chloride.

The invention will now be elucidated by means of the following, non-limiting example.

Example

Pour point depression, viscosity modification and cloud point depression of a mixture comprising a gas condensate fluid and 5% wt of a commercial synthetic wax.

A standard solution was prepared containing 95% wt of a stabilised gas condensate fluid (Tietjerk) and 5% wt of a commercial synthetic wax (Shell Sarawax SX50, having a melting point of 50° C.). This solution represents a waxy hydrocarbon fluid and will be called WHF in the description of the experiments.

The experiments were conducted with a number of HYBRANE compounds (ex DSM), referred herein as H1 to H13.

H1: a condensation product of 80 mol % phthalic anhydride and 20 mol % polyisobutenyl succinic anhydride, the polyisobutenyl chain having a mol weight of 1300, with di-isopropanolamine. The hydroxyl end groups were for 90% reacted with stearic acid. The Mn was 4500.

H2: a condensation product of 80 mol % of succinic anhydride and 20 mol % polyisobutenyl succinic anhydride, the polyisobutenyl chain having a mol weight of 1300, with di-isopropanolamine. The hydroxyl end groups were for 90% reacted with stearic acid. The Mn was 4300.

H3: a condensation product of succinic anhydride and di-isopropanol amine. The hydroxyl end groups were for 90% reacted with stearic acid. The Mn was 3100.

H4: a condensation product of hexahydrophthalic anhydride with di-isopropanol amine. The hydroxyl end groups were for 90% reacted with behenic acid. The Mn was 3700.

H5: a condensation product of succinic acid and di-isopropanol amine. The hydroxyl end groups were for 90% reacted with behenic acid. The Mn was 3500.

H6: a condensation product of 30 mol % phthalic anhydride and 70 mol % succinic anhydride with di-isopropanol amine. The hydroxyl end groups were reacted with stearic acid. The number of stearate groups was on average 8 per molecule. The Mn was 3200.

H7: a condensation product of 80 mol % succinic anhydride and 20 mol % dodecenyl succinic anhydride and di-isopropanol amine. The hydroxyl end groups were reacted with stearic acid. The number of stearate groups was on average 8 per molecule. Mn was 3100.

H8: a condensation product of succinic anhydride with di-isopropanolamine. Excess acid anhydride was used to obtain carboxylic end groups. The carboxylic end groups were reacted with n-alkyl alcohols with an average chain length of 20 carbon atoms. The Mn was 4300.

H9: a condensation product of 50 mol % of succinic anhydride and 50 mol % polyisobutenyl succinic anhydride, the polyisobutenyl chain having a mol weight of 1300, with di-isopropanolamine. The hydroxyl end groups were reacted with stearic acid. The number of stearate groups was on average 8 per molecule. The Mn was 5900.

H10: a condensation product of succinic anhydride and di-isopropanol amine. The hydroxyl end groups were for 50 mol % reacted with behenic acid and for 50 mol % with 2-ethylhexanoic acid. The Mn was 2800.

H11: a condensation product of 50 mol % of succinic anhydride and 50 mol % polyisobutenyl succinic anhydride, the polyisobutenyl chain having a mol weight of 1300, with di-isopropanolamine. The hydroxyl end groups were reacted with behenic acid. The number of behenate groups was on average 8 per molecule. The Mn was 6200.

H12: a condensation product of dodecenyl succinic anhydride and di-isopropanol amine. The hydroxyl end groups were reacted with behenic acid. The number of behenate groups was on average 8 per molecule. Mn was 4300.

H13: a condensation product of succinic anhydride and di-isopropanol amine. The hydroxyl end groups were for ⅓ reacted with stearic acid, for ⅓ with lauric acid and for ⅓ with behenic acid. The Mn was 3200.

Experiment 1 Depression of the Cloud Point by H1-H5

In these experiments the cloud point of the mixture was determined using optical microscopy. Here a small aliquot of the sample was placed on a microscope glass and placed on a thermostated hot/cold stage (Linkam PE120 with PE94 control unit). The sample was observed through a microscope using a technique, known as cross-polar microscopy by those skilled in the art. The occurrence of wax crystals is clearly visible in this technique as they show up as light spots against a dark background. The temperature was lowered from 20° C. to 0° C. at a rate of 1° C. per minute, while the sample was observed through the microscope. The cloud point is defined as the temperature of the sample at the moment that the first wax crystals are observed.

The cloud points of the fluids are apparent in the Table below. The amount of the H1-H5 compound was 1000 ppmw (0.1% wt).

| Polyester amide | Cloud point, ° C. |
|---|---|
| — | 10.8 |
| H1 | 10.7 |
| H2 | 10.4 |
| H3 | 10.3 |
| H4 | 7.7 |
| H5 | 7.4 |

Experiment 2 Pour Point Depression

The solution WHF was poured in a 40 ml glass vessel and submerged in a water bath that was kept at 0° C. for about one hour. After this time the fluid had solidified and did not move or flow upon slowly moving the glass vessel. Another vessel that was prepared in the same way was stored in a freezer at −30° C. for one hour. After this time the fluid had solidified and did not move or flow upon moving the glass vessel. This shows that the pour point of liquid WHF is higher then 0° C.

A new solution was prepared by adding to the WHF solution described above 0.1% wt of the compound H5. The above experiments were repeated. Now the sample that was stored at 0° C. and the sample that was stored at −30° C. were opaque, indicating that wax had precipitated, but still free flowing liquids. These experiments show that the pour point is markedly reduced by using H5 in the solution. In fact the pour point of the solution with H5 is thus shown to be less than −30° C.

Experiment 3 Effect of Dendrimeric Additive on Fluid Viscosity

An aliquot of solution WHF was transferred to a commercial cup-and-bob type rheometer (Physica MCR100) at a temperature of 20° C. The viscosity of the solution was continuously measured by determining the torque on the rotating cylinder while the temperature was slowly lowered from 20 to 0° C. (approximately 1° C. per minute). The shear rate in the solution was fixed at 40/s. The viscosity of the solution remained relatively low (<1 mPas) until a temperature of 10° C. was reached. Subsequently the viscosity increased steeply with decreasing temperature to a level of approximately 10 mPas at 0° C.

A new solution was prepared by adding to the standard solution WHF 0.1% wt of the dendrimeric compound H5. The rheometer experiments described above were repeated with this solution. Now the viscosity showed a relatively rapid increase at 5° C. but only to reach a level of approximately 2 mPas at 0° C.

At temperatures above 10° C. there was no significant viscosity difference between the solutions with and without H5. These experiments show that the addition of H5 reduces the apparent viscosity of the fluid at temperatures below the cloud point whereas at temperatures above the cloud point, the effect on the fluid viscosity is negligible.

Experiment 4: Flow Behaviour

The behaviours of several HYBRANE compounds were tested in a solution of 95% wt of a stabilised gas condensate fluid (Tietjerk) and 5% wt of a commercial synthetic wax (a mixture of Shell SARAWAX SX50 having a melting point of 50° C. and Shell SARAWAX SX 70 having a melting point of 70° C.). The concentration of the HYBRANE compounds is indicated in the Table below. The mixture was kept in a bottle at −27° C. for one hour. It was determined whether the solution was still flowing ("F"), whether it flowed after mild agitation ("F-A"), or whether it was solid ("S").

The results are indicated in the Table below.

| Additive | Amount (ppm) | Flow result |
|---|---|---|
| — | — | S |
| H1 | 1000 | F |
| H2 | 1000 | F |
| H3 | 1000 | F |
| H4 | 250 | F |
| H5 | 1000 | F-A |
| H6 | 250 | F-A |
| H7 | 250 | F-A |
| H8 | 250 | F-A |
| H10 | 250 | F |
| H11 | 250 | F |
| H12 | 250 | F |
| H13 | 250 | F |

Experiment 5: Oil Flow

The behaviour of 250 ppm of some HYBRANE compounds, viz. H4-H5 and H7-H9, in a waxy black oil (St Joseph, a crude oil from Malaysia known for its problems with wax precipitation in the flowlines) was tested by keeping the mixture of the oil and the additive at 16° C. for one hour. Then it was determined whether the mixture was still flowing.

The oil without additive was solid at these conditions.

The mixtures with 250 ppm H4, H7 or H9 flew after mild agitation, and the mixtures with 250 ppm H5 or H8 had not solidified at all.

What is claimed is:

1. A method for improving the flowability of crude oil comprising:

flowing the crude oil in at least one of a conduit or flow line, wherein the crude oil comprises wax and other hydrocarbons;

adding to the crude oil an amount of a dendrimeric hyperbranched polyester amide, wherein the dendrimeric hyperbranched polyester amide has been functionalized by a reaction with behenic acid, stearic acid, or an n-alkanol with 12 to 30 carbon atoms to provide the dendrimeric hyperbranched polyester amide with a $C_{4-40}$ alkyl end group; and allowing the dendrimeric hyperbranched polyester amide to prevent crystallization of the wax in the crude oil.

2. The method according to claim 1, in which the dendrimeric hyperbranched polyester amide is prepared by a (self-) condensation reaction between a cyclic anhydride and an alkanolamine.

3. The method according to claim 2, in which the alkanolamine is a di- or trialkanolamine.

4. The method according to claim 2, in which the cyclic anhydride is selected from the group consisting of succinic anhydride, glutaric anhydride, tetrahydrophthalic anhydride, hexahydrophthalic anhydride, phthalic anhydride, norbornene-2,3-dicarboxylic anhydride, and naphthalenic dicarboxylic anhydride.

5. The method according to claim 4, in which the cyclic anhydride is aliphatic.

6. The method according to claim 5, in which the cyclic anhydride is succinic acid.

7. The method according to claim 1, in which the dendrimeric hyperbranched polyester amide has been functionalized by a reaction with behenic acid.

8. The method according to claim 1, in which the dendrimeric hyperbranched polyester amide has molecular weight from 500 to 50,000.

9. The method according to claim 1, in which the amount of dendrimeric hyperbranched polyester amide added to the crude oil is from 0.01 to 10% wt based on the total weight of the crude oil and the dendrimeric hyperbranched polyester amide.

10. The method according to claim 1, further comprising adding oil-field chemicals to the crude oil.

11. The method according to claim 1, wherein the crude oil further comprises water, brine or gas.

12. The method according to claim 3, in which the cyclic anhydride is selected from the group consisting of succinic anhydride, glutaric anhydride, tetrahydrophthalic anhydride, hexahydrophthalic anhydride, phthalic anhydride, norbornene-2,3-dicarboxylic anhydride, and naphthalenic dicarboxylic anhydride.

13. The method according to claim 1, in which the dendrimeric hyperbranched polyester amide has been functionalized by a reaction with stearic acid.

14. The method according to claim 1, in which the dendrimeric hyperbranched polyester amide has been functionalized by a reaction with an n-alkanol with 12 to 30 carbon atoms.

15. A method for improving the flowability of crude oil comprising:

flowing the crude oil in at least one of a conduit or flow line;

adding to the crude oil an amount of a dendrimeric hyperbranched polyester amide, wherein the dendrimeric hyperbranched polyester amide has been functionalized by a reaction with behenic acid, stearic acid, or an n-alkanol with 12 to 30 carbon atoms to provide the dendrimeric hyperbranched polyester amide with a $C_{4-40}$ alkyl end group; and allowing the dendrimeric hyperbranched polyester amide to prevent crystallization of the wax in the crude oil.

16. A method for improving the flowability of crude oil comprising:

flowing the crude oil in at least one of a conduit or flow line and adding to the crude oil an amount of a dendrimeric hyperbranched polyester amide, wherein the dendrimeric hyperbranched polyester amide has been functionalized by a reaction behenic acid, stearic acid, or an n-alkanol with 12 to 30 carbon atoms.

* * * * *